US005390446A

United States Patent [19]

Kazui et al.

[11] Patent Number: 5,390,446

[45] Date of Patent: Feb. 21, 1995

[54] GRINDING METHOD AND GRINDING MACHINE

[75] Inventors: Shinichi Kazui, Hadano; Hiroyuki Ogino, Kanagawa; Kenji Morita, Isehara; Kuninori Imai, Kanagawa; Hideaki Sasaki, Hadano; Takao Oguro, Yokohama, all of Japan

[73] Assignees: Hitachi, Ltd., Tokyo; Hitachi Seiko, Ltd., Kanagawa, both of Japan

[21] Appl. No.: 900,572

[22] Filed: Jun. 18, 1992

[30] Foreign Application Priority Data

Jun. 21, 1991 [JP] Japan ..... 3-149098

[51] Int. Cl.[6] ..... B24B 1/00

[52] U.S. Cl. ..... 451/8; 451/41

[58] Field of Search ..... 51/281 R, 283 R, 326, 51/165.74, 165.77; 125/13.01, 12

[56] References Cited

U.S. PATENT DOCUMENTS 4,067,311 1/1978 Benetello ..... 51/283 R 4,839,996 6/1989 Sekiya ..... 51/283 R

*Primary Examiner*—Robert A. Rose

*Attorney, Agent, or Firm*—Fay, Sharpe, Beall, Fagan, Minnich & McKee

[57] ABSTRACT

A grinding method and a grinding machine of reduced grinding resistance, in which letting f [mm] denote the diamond particle size of a diamond grindstone, V [m/min] denote the peripheral speed of the diamond grindstone, and f [m/min] denote the feed speed of a workpiece made of Aluminum nitride ceramic, the peripheral speed of the diamond grindstone and the feed speed of the workpiece are set so as to satisfy $V \geqq 35\phi + 2000$ and $V/f \geqq 70\phi + 800$.

4 Claims, 9 Drawing Sheets

FIG.9

| ITEMES | PRIOR ART | THIS EMBODIMENT |
|---|---|---|
| REVOLUTION SPEED OF GRINDSTONE (rpm) | 5000 | 14000 |
| DIAMETER OF GRINDSTONE (mm) | 100 | 110 |
| PERIPHERAL SPEED OF GRINDSTONE (m/min) | 1570 | 4835 |
| FEED SPEED OF WORKPIECE (mm/min) | 100 | 1000 |
| PERIPHERAL SPEED OF GRINDSTONE (m/min) / FEED SPEED OF WORKPIECE (m/min) | 15700 | 4835 |
| DEPTH OF CUT (mm) | 3 | 4 |
| GROOVE WIDTH (mm) | 0.3～0.6 | 0.6 |
| PITCH ACCURACY (μm) | ± 15 | ± 5 |
| ORTHOGONALITY OF GROOVE (μm/mm(DEPTH)) | 10～5 | 2.5 |
| ACCURACY OF GROOVE WIDTH (μm) | ± 50 | ± 25 |
| LIFETIME OF GRINDSTONE (m) | 8 | 50 |
| VOLUME OF GRINDING PER UNIT TIME (mm /mm) | 90～180 | 2400 |

GRINDING METHOD AND GRINDING MACHINE

BACKGROUND OF THE INVENTION

1. Field of the Invention

The present invention relates to a grinding method and a grinding machine in which a workpiece is ground by rotating a grindstone. More particularly, it relates to a method and a machine suited for grinding ceramics.

2. Description of the Related Art

Ceramics are materials which have come into the limelight in various fields in recent years. The ceramics usually have the property of being hard and fragile unlike metal materials etc. having hitherto been extensively employed. Therefore, the machining of ceramics into desired shapes is attended with several difficulties.

It is known that, in grinding ceramics, a diamond grindstone is ordinarily used. By way of example, when Aluminum nitride (aluminum nitride) ceramic is to be ground, the peripheral speed of the diamond grindstone is set at about 1500 [m/min], and the feed speed of a workpiece is set at 100 [mm/min].

Notwithstanding that ceramics are very much used materials, it is difficult to say that research has been satisfactorily carried out with respect to grinding technology therefor. Especially, conditions to be set for efficient grinding, etc. are not being studied actively at the present time.

SUMMARY OF THE INVENTION

Accordingly, the present invention has for its object the specifying of appropriate grinding conditions utilizing the characteristics of a ceramic and then provide a grinding method and a grinding machine capable of efficient grinding.

A grinding method for accomplishing the object is characterized by preliminarily measuring a grinding resistance of a workpiece dependent upon a revolution speed of a grindstone to determine a revolution speed of the grindstone at which the grinding resistance of the workpiece comes to hardly change any more; and rotating the grindstone at a revolution speed not lower than the so determined revolution speed to grind the workpiece.

Besides, in a case where the workpiece is made of aluminum nitride ceramic, the diamond grindstone should preferably be rotated so that its peripheral speed V [m/min] satisfies:

$$V \geqq 35\,\phi + 2000 \qquad (1)$$

where $\phi$ [$\mu$m] denotes a diamond particle size of the diamond grindstone.

In addition, a ratio V/f between the peripheral speed V [m/min] of the diamond grindstone and a feed speed f [m/min] of the workpiece should preferably be set so as to satisfy:

$$V/f \geqq 70\,\phi + 800 \qquad (2)$$

where $\phi$[$\mu$m] denotes the diamond particle size of the diamond grindstone.

Preferably, the peripheral speed of the diamond grindstone and the feed speed of the workpiece are evaluated from the aforementioned two formulae, and the workpiece is ground under these grinding conditions.

Another grinding method for accomplishing the object is characterized by supplying a grinding fluid at a speed not lower than the peripheral speed of the grindstone and in a direction tangential to the grindstone.

In general, in a case where a required grinding force is small, the machining of a workpiece is easy, and the magnitude of deformation of, e.g., the rotating spindle of a grindstone decreases subject to an identical rigidity, so that the accuracy of grinding increases. Accordingly, when the workpiece is ground under the grinding conditions under which the grinding resistance becomes small, the efficiency and accuracy of the grinding can be enhanced.

Meanwhile, variation in a grinding resistance was investigated while the peripheral speed of a grindstone for grinding was changed. From these investigations, it has been revealed that the grinding resistance decreases comparatively abruptly until a certain peripheral speed value with the increase of the peripheral speed, but that it comes to hardly change beyond this certain value and reaches its minimum value.

Subsequently, the relationship between the peripheral speed of such values and the diamond particle size of the diamond grindstone was investigated. Then, it was revealed that the relationship between the peripheral speed and the diamond particle size is expressed as indicated by the above formula (1) for a workpiece made of aluminum nitride ceramic.

Accordingly, when the workpiece is ground at the peripheral speed satisfying Formula (1), the grinding efficiency and the grinding accuracy can be enhanced as stated before. Further, the power consumption of a driving motor etc. can be lowered owing to the decrease of the grinding resistance.

In the case of grinding the ceramic material, grinding conditions need to be specified lest it should crack. The cracking of the ceramic pertains to the peripheral speed of the grindstone as well as the feed speed of the workpiece and the diamond particle size of the diamond grindstone, and the grinding conditions for avoiding the cracking are indicated by the above formula (2). When the peripheral speed of the grindstone and the feed speed of the workpiece are set so as to satisfy the grinding conditions, the workpiece can be prevented from cracking, and hence, the grinding efficiency can be enhanced from the standpoint of the overall productivity.

Incidentally, since the peripheral speed of the grindstone can be determined by Formula (1), the workpiece feed speed can be set using the determined value and Formula (2).

Moreover, although Formulae (1) and (2) are applied in the case of grinding the Aluminum nitride ceramic, similar relationships generally hold true for other ceramics. It is therefore advisable to preliminarily derive the relational formulae similar to Formulae (1) and (2) before grinding a large quantity of workpieces, and to specify the grinding conditions on the basis of the derived relational formulae.

BRIEF DESCRIPTION OF THE DRAWINGS

FIG. 9 is an explanatory diagram showing the comparisons between grinding conditions, grinding accuracies etc. in an embodiment of the present invention and those in the prior art.

PREFERRED EMBODIMENTS OF THE INVENTION

Now, embodiments of the present invention will be described with reference to FIGS. 1 thru 9.

Various tests were conducted on grinding conditions in the case of grinding Aluminum nitride ceramic by the use of a diamond grindstone, and they will be explained below. By the way, the diamond grindstone was of the metal bond type, and the Aluminum nitride ceramic was doped with a slight amount of $Y_2O_3$ as a sintering assistant.

INFLUENCE OF REVOLUTION SPEED OF GRINDSTONE ON GRINDING RESISTANCE

First, the influence of the revolution speed of the grindstone exerted on the grinding resistance thereof was tested. It will be explained with reference to FIGS. 1 and 2.

In this test, the diamond grindstone employed had a diameter of 100 [mm], a width of 0.64 [mm] and a diamond particle size of 44 [μm] (325 [meshes]). Incidentally, a groove ground in this test was 4 [mm] deep.

Figure 1:
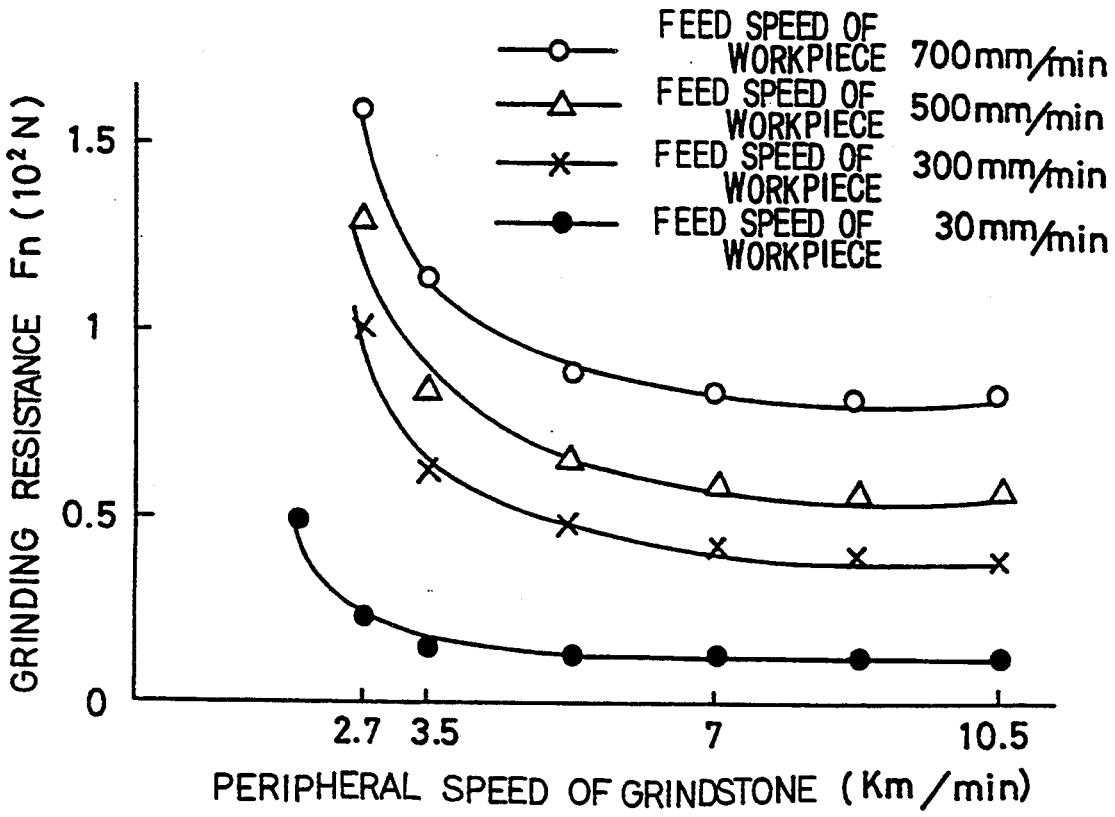
FIG. 1 is a graph showing the relationship between the grinding resistance of a workpiece in the normal direction of a grindstone and the peripheral speed of the grindstone.

As illustrated in FIG. 1, irrespective of the feed speed f [mm] of a workpiece made of the Aluminum nitride ceramic, the grinding resistance Fn of the workpiece in the normal direction of the grindstone decreases abruptly with the increase of the peripheral speed V of the grindstone until the value of the peripheral speed V reaches 3.5 [km/min]. In contrast, the grinding resistance Fn remains on substantially the same level beyond the aforementioned value of the peripheral speed V.

Figure 2:
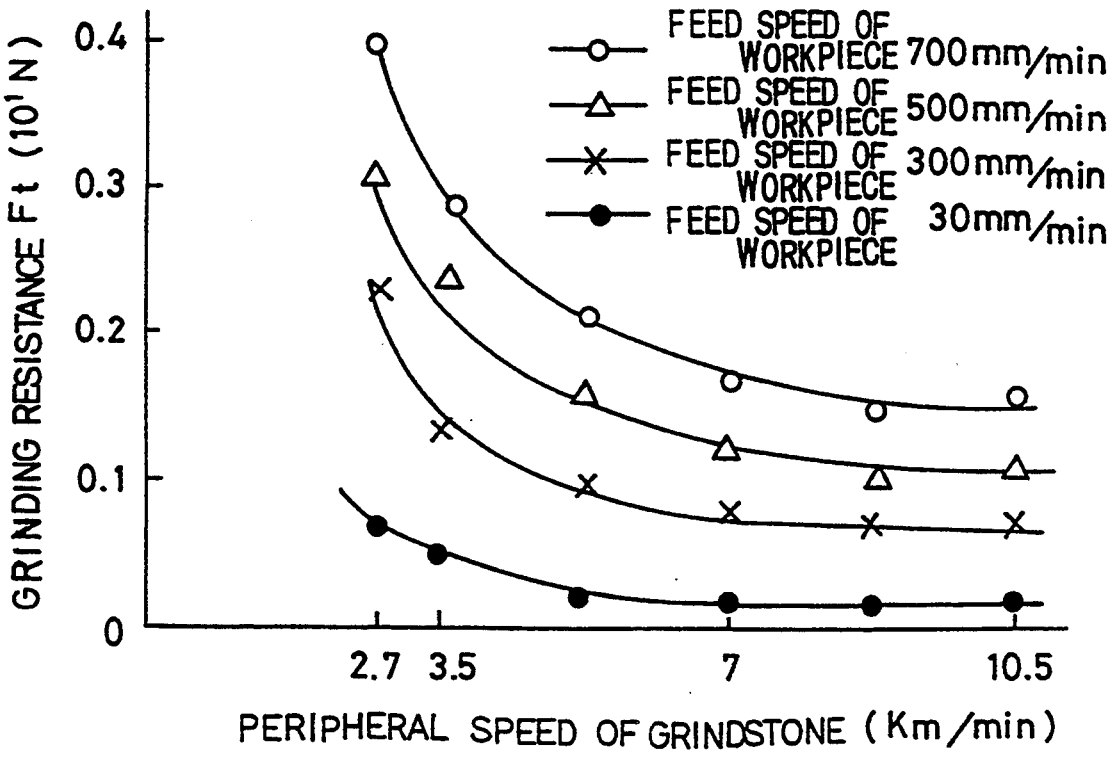
FIG. 2 is a graph showing the relationship between the grinding resistance of the workpiece in the tangential direction of the grindstone and the peripheral speed of the grindstone.

Also, as illustrated in FIG. 2, the grinding resistance Ft of the workpiece in the tangential direction of the grindstone exhibits no considerable decrease in spite of the increase of the peripheral speed V of the grindstone on condition that the peripheral speed V exceeds the value of 3.5 [km/min].

In this manner, it has been revealed that, as regards the ceramic, when the peripheral speed V of the grindstone exceeds a certain value, the grinding resistance hardly changes thenceforth, whereupon the grinding resistance becomes its minimum value.

Herein, that minimum peripheral speed Vmin of the grindstone at which the grinding resistance comes to remain substantially constant is greatly different depending upon the particle size of the grindstone. Therefore, the relationship between the minimum peripheral speed Vmin of the grindstone and the particle size thereof was tested, and it will be explained below.

Figure 3:
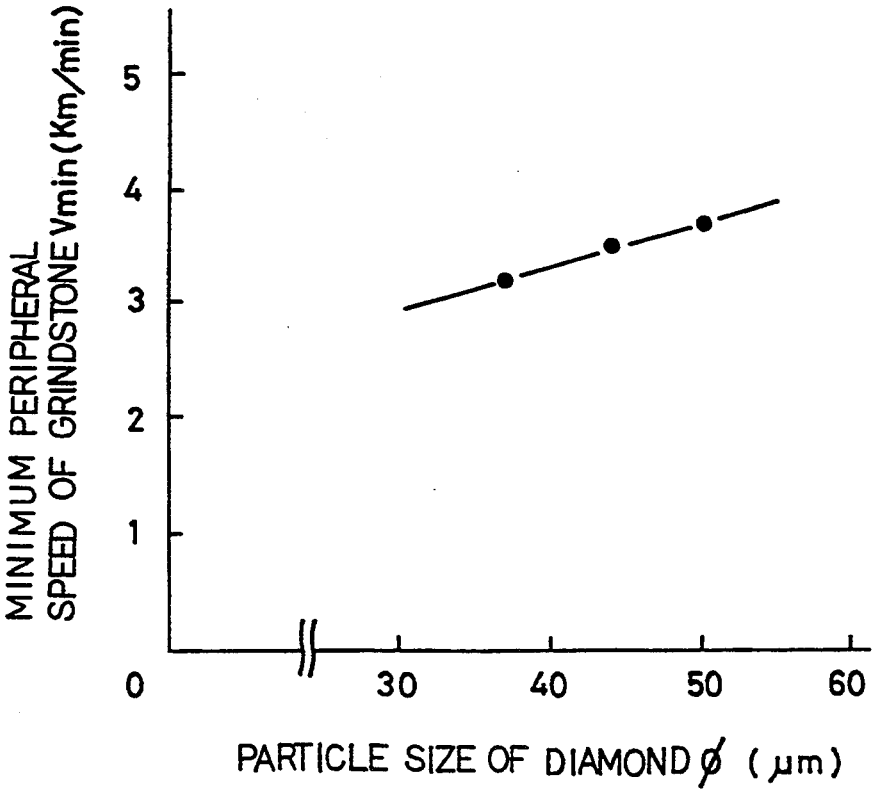
FIG. 3 is a graph showing the relationship between the peripheral speed of the grindstone and the diamond particle size thereof.

Regarding the relationship between the minimum peripheral speed Vmin of the grindstone and the particle size $\phi$ thereof, it has been revealed that, as illustrated in FIG. 3, the minimum peripheral speed Vmin [m/min] increases rectilinearly with the enlargement of the particle size $\phi$ [μm] as indicated by Formula (1):

$$Vmin = 35\,\phi + 2000 \quad (1)$$

The grinding resistance may be considered as the barometer of machinability. Usually, in a case where the grinding resistance is small, the accuracy of grinding increases as well as easy machining. This holds true also for the grinding of general ceramics. In the case of grinding the Aluminum nitride ceramic, accordingly, when the workpiece is ground at a peripheral speed equal to or higher than the peripheral speed Vmin meeting Formula (1), the grinding resistance is minimized, and the grinding efficiency as well as the grinding accuracy is enhanced. Moreover, when the grinding resistance is small, naturally the power consumption of a motor for rotating the grindstone and a motor for feeding the workpiece can be lowered.

INFLUENCE OF WORKPIECE FEED SPEED ON GRINDING RESISTANCE

The influence of the feed speed of the workpiece exerted on the grinding resistance of the workpiece was tested. It will be explained with reference to FIG. 4. Also in this test, the same diamond grindstone as in the test concerning the influence of the revolution speed of the grindstone exerted on the grinding resistance was employed. In addition, the peripheral speed V of the grindstone was 2763 [m/min], and the depth of a ground groove was 4 [mm].

Figure 4:
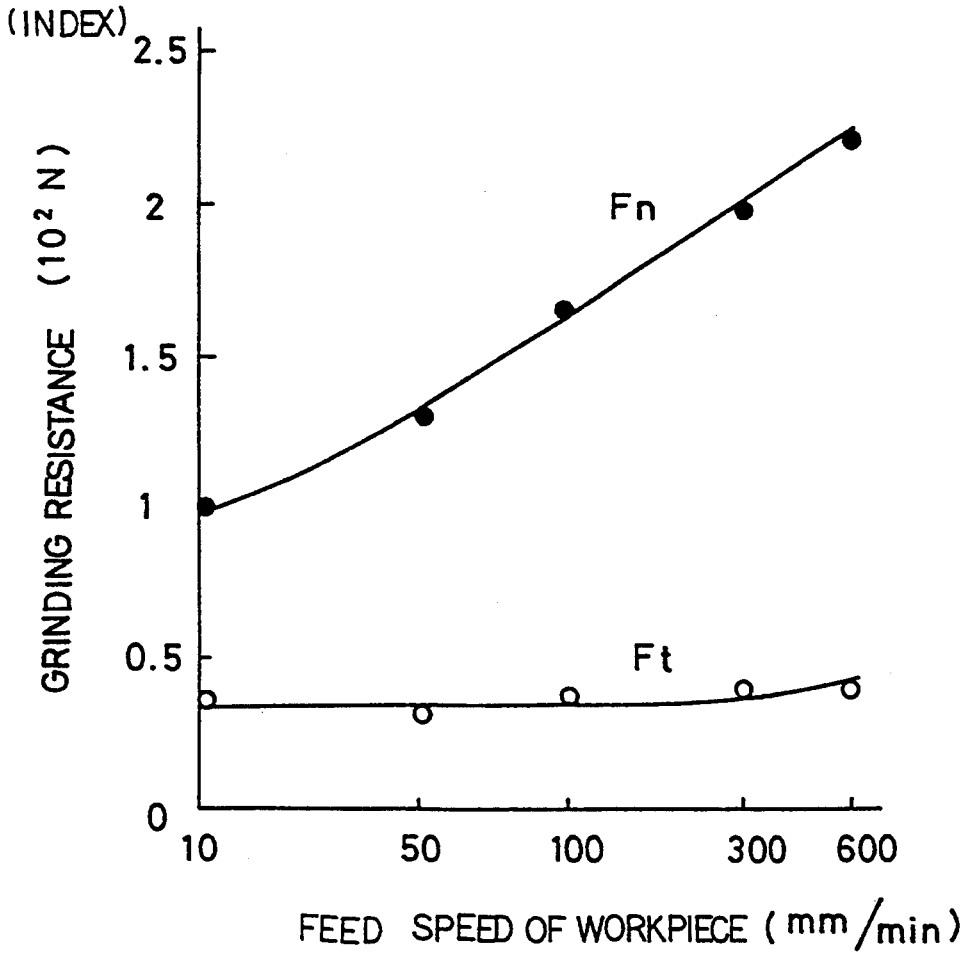
FIG. 4 is a graph showing the relationships between the grinding resistance and the feed speed of a workpiece.

As illustrated in FIG. 4, the grinding resistance Fn of the workpiece in the normal direction of the grindstone increases with the increase of the workpiece feed speed f. In contrast, the grinding resistance Ft of the workpiece in the tangential direction of the grindstone hardly changes in spite of the increase of the workpiece feed speed f.

Herein, when the workpiece feed speed f increases about 3 times from 100 [mm/min] to 300 [mm/min] by way of example, the grinding resistance Fn in the normal direction increases only about 1.25 times from 160 [N] to 200 [N].

Accordingly, neither the grinding resistance Fn in the normal direction nor the grinding resistance Ft in the tangential direction changes considerably in spite of the increase of the workpiece feed speed f. Therefore, as the workpiece feed speed f is raised more, the volume of grinding per unit power consumption and the volume of grinding per unit time can be increased more.

However, the workpiece feed speed f cannot be increased unconditionally, but it is limited to a certain value in relation to the cracking of the workpiece. The limitation within which the workpiece does not crack will be elucidated below.

CRACKING LIMITATION

In general, since ceramics have the properties of high hardness and high fragility, they often crack under some grinding conditions. The grinding conditions under which the cracks appear in this manner must be avoided no matter how excellent they are from the viewpoint of the grinding efficiency.

Figure 5:
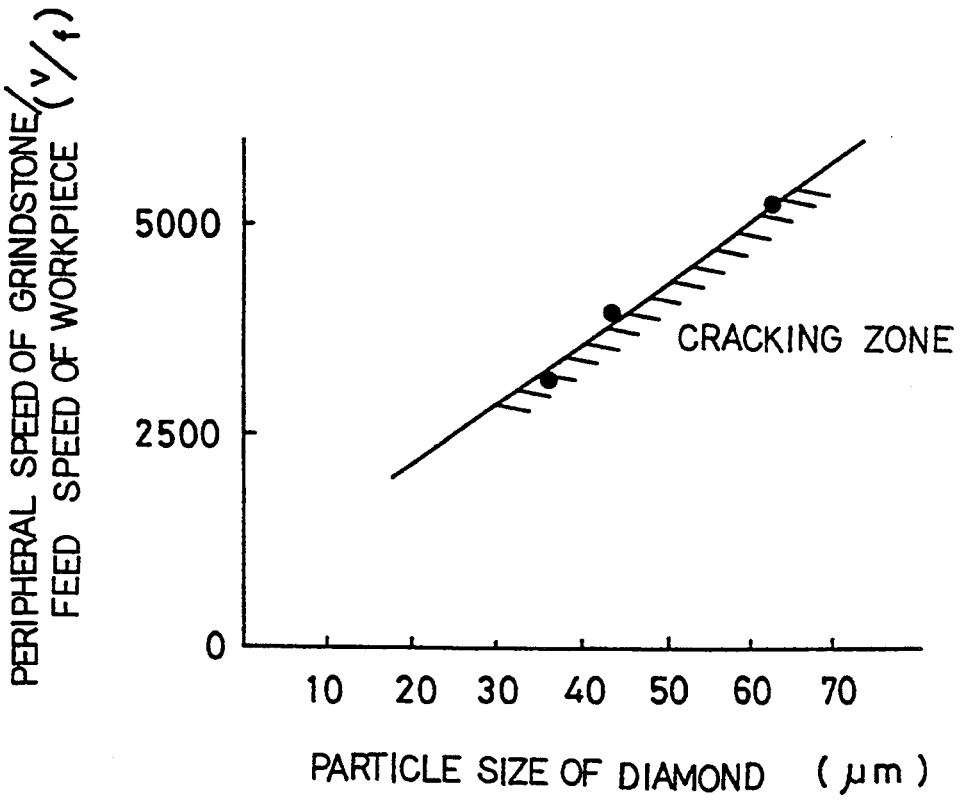
FIG. 5 is a graph showing the cracking conditions of the workpiece in terms of the relationship between the ratio of the peripheral speed of the grindstone to the feed speed of the workpiece and the diamond particle size of the grindstone.

FIG. 5 illustrates a result obtained by investigating the cracking limitation of the Aluminum nitride ceramic with a scale being the ratio between the peripheral speed V [m/min] of the grindstone and the feed speed f [mm/min] of the workpiece. It has been revealed from this result that the cracking of the workpiece depends upon the diamond particle size $\phi$[$\mu$m] of the diamond grindstone, and that, when the particle size $\phi$[$\mu$m] is small, the workpiece does not lead to the cracking even at a small V/f ratio value.

More specifically, when the following formula (2) is satisfied, the workpiece can be prevented from cracking:

$$V/f \geqq 70\,\phi + 800 \qquad (2)$$

When the lower limit of the ratio V/f is determined by Formula (2), the cracking of the workpieces can be prevented, and nonconforming articles can be decreased in number, so that the enhancement in the grinding efficiency can be achieved eventually.

Herein, since the peripheral speed V of the grindstone in Formula (2) can be determined by Formula (1), the workpiece feed speed f can be set in accordance with the determined speed V of the grindstone and Formula (2).

Specifically, in the grinding of the Aluminum nitride ceramic, the grindstone whose diamond particle size $\phi$ is 44 [$\mu$m] (325 [meshes]) or 37 [$\mu$m] (400 [meshes]) is often employed in relation to chippings which come out. In this case, assuming that the peripheral speed V of the grindstone is 4835 [m/min] in accordance with Formula (1) (the lowest peripheral speed evaluated by Formula (1) when the particle size $\phi$ is 44 [$\mu$m], is 3500 [m/min]), the feed speed f becomes 1000 [mm/min] in accordance with Formula (2) (the highest feed speed evaluated by Formula (2) when the particle size $\phi$ is 44 [$\mu$m], is 1250 [mm/min]).

INFLUENCE OF DEPTH OF CUT ON GRINDING RESISTANCE

The influence of the depth of cut in the workpiece exerted on the grinding resistance of the workpiece was tested. It will be explained with reference to FIG. 6. Also in this test, the same diamond grindstone as in the test concerning the influence of the revolution speed of the grindstone exerted on the grinding resistance was employed. In addition, the peripheral speed V of the grindstone was 2763 [m/min], and the workpiece feed speed f was 100 [mm/min].

Figure 6:
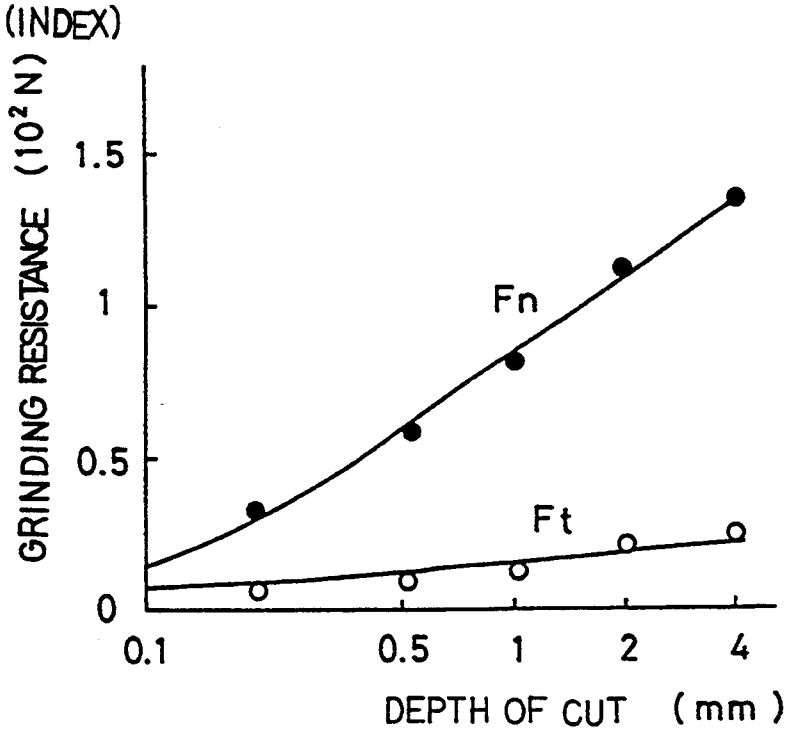
FIG. 6 is a graph showing the relationships between the grinding resistance and the depth of cut of the workpiece.

As illustrated in FIG. 6, the grinding resistance Fn in the normal direction and the grinding resistance Ft in the tangential direction increase with the increase of the depth of cut d.

Herein, when the depth of cut d increases about 4 times from 0.5 [mm] to 2 [mm] by way of example, the grinding resistance Fn in the normal direction increases only about 1.33 times from 60 [N] to 80 [N]. In addition, the grinding resistance Ft in the tangential direction hardly increases in spite of the increase of the depth of cut d.

Accordingly, neither the grinding resistance Fn in the normal direction nor the grinding resistance Ft in the tangential direction changes considerably in spite of the increase of the depth of cut d. Therefore, as the depth of cut d is increased more, the volume of grinding per unit power consumption can be increased more.

By the way, the depth of cut (the depth of a groove) d is ordinarily determined relative to a groove width in relation to the machining accuracy of the groove, etc. In consideration of the above results, it will be preferable to set the aspect ratio of the groove (the groove depth/the groove width) at 6 or greater.

In view of the test results thus far explained, a grinding machine of high grinding efficiency and high grinding accuracy was manufactured by way of trial. It will now be described.

Figure 7:
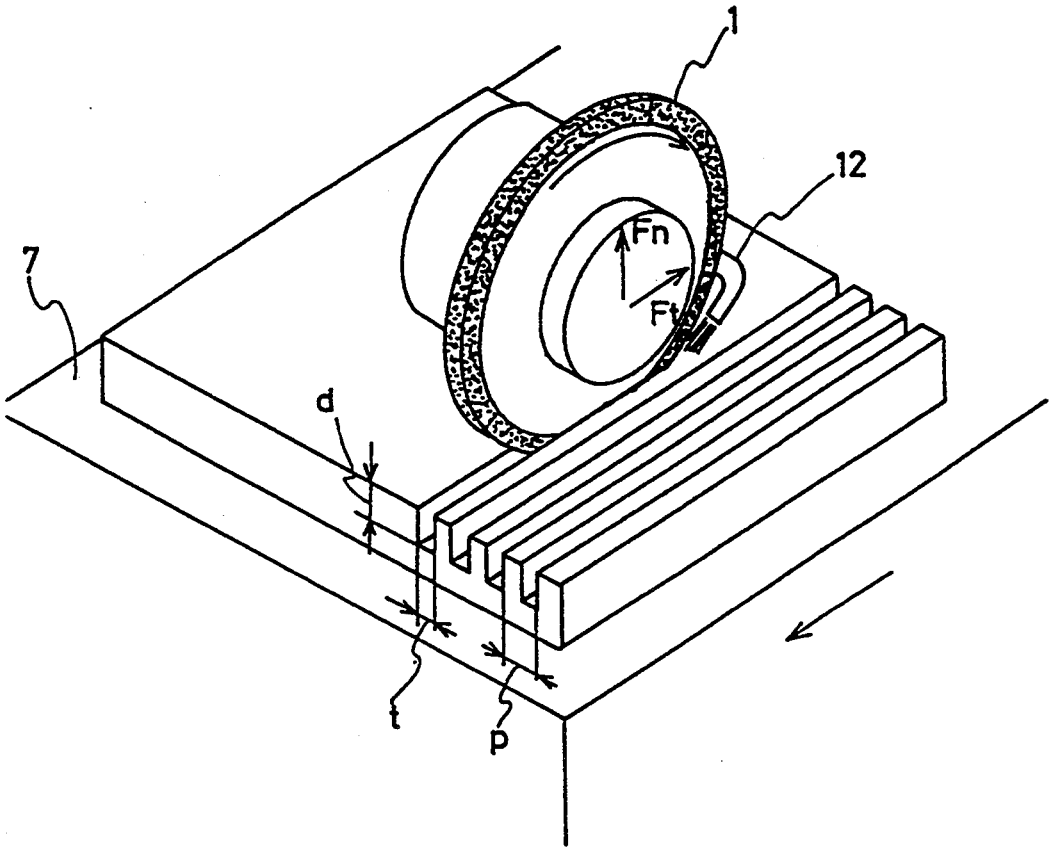
FIG. 7 is a general perspective view of a workpiece and a grindstone in an embodiment of the present invention.

As shown in FIG. 7, the grinding machine served to fabricate a comb-shaped structure made of the Aluminum nitride ceramic. The detailed dimensions of the structure etc. were as listed below:

Dimensions of Workpiece: approx. 100×100 [mm]
Groove depth: 3 [mm] to 5 [mm]
Groove Width t: 0.3 [mm] to 0.8 [mm]
Groove Pitch p: 1 [mm] to 2 [mm]
Number of Grooves: 50 to 100
Total Groove Length L: 5 [m] to 10 [m]

The Aluminum nitride ceramic is excellent in such properties as thermal conduction and electric insulation, and the structure is used as, for example, the heat sink or the coiling piece of an electronic component for a computer.

Figure 8:
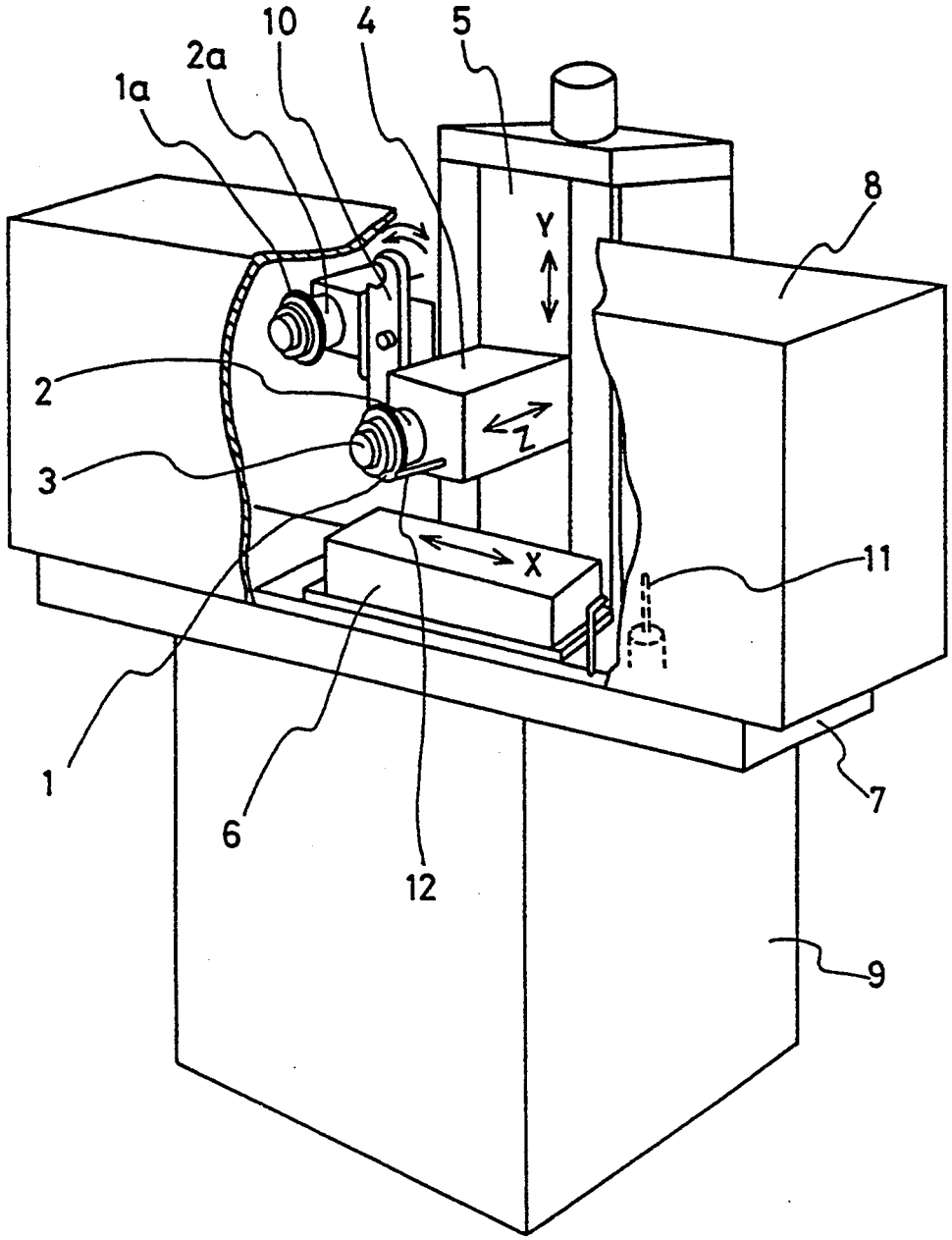
FIG. 8 is a general perspective view of a grinding machine in the embodiment of the present invention.

As depicted in FIG. 8, the grinding machine is constructed having a grindstone flange 2 to which a disc-like diamond grindstone 1 is attached, a spindle (not shown) which rotates the grindstone 1 as well as the grindstone flange 2, an autobalancer which includes a balancer tank 3 and which holds the dynamic balance of the rotating elements such as the grindstone 1, a Z-axial table 4 which moves the grindstone 1 in the horizontal direction, a Y-axial table 5 which moves the Z-axial table 4 in the vertical direction, a work table 6 to which workpieces are attached, an X-axial table 7 which moves the work table 6 in the horizontal direction, a grindstone for replacement 1*a* as well as a grindstone flange for replacement 2*a*, an automatic tool change mechanism 10 by which the grindstone for replacement 1*a* and the grindstone flange for replacement 2*a* are respectively changed for the grindstone 1 and grindstone flange 2 mounted on the Z-axial table 4, a totally-enclosed cover 8 which is provided with an automatic door and which conceals the workpieces, the grindstone 1, etc., a coolant supply mechanism which includes a nozzle 12 and which supplies a coolant (grinding fluid) to the part of the workpiece to-be-ground, a sensor 11 which detects the diameter of the grindstone 1 and the position thereof in the Z-direction, a base 9 on which the various constituents mentioned above are placed, and a control device (not shown) which controls the operations as explained above.

In order to machine the material of high fragility at high accuracies, the spindle is endowed with a diameter of 70 [mm] and a rigidity of at least 5 [kg/$\mu$m]. Ceramic ball bearings are adopted as the bearings of the spindle, and oil-air lubrication is adopted for cooling them. The spindle can be rotated at 8,000–15,000 [r.p.m.] so as to realize the peripheral speed stated before. Accordingly, the DN number of the spindle becomes 1,050,000 (the diameter of the spindle 70 [mm]×the revolution speed thereof 15,000 [r.p.m.]), and this value is much greater than ordinary DN numbers. Incidentally, the diamond grindstone 1 which is chiefly set on the grinding machine of this embodiment has a diameter of 110 [mm], a width of 0.64 [mm] and a diamond particle size of 44 [μm] (325 [meshes]).

The work table 6 has such dimensions that the workpieces in the number of 5, each having the dimensions of approximately 100×100 [mm], can be arrayed in the moving direction of the X-axial table 7 and mounted on this table. Accordingly, the work table 6 is provided with a plurality of vacuum suction ports so as to be capable of vacuum-chucking the five workpieces.

The X-axial table 7 is set at a moving width of at least 610 [mm] (=the length 100 [mm] of each workpiece×5+the diameter 110 [mm] of the grindstone) so that the five workpieces attached to the work table 6 can be ground at one stroke. Since the grinding of the five workpieces can be executed at one stroke in this way, a time period during which the grindstone 1 is idling, etc. can be avoided, and the operation efficiency of the grinding can be increased. Besides, in order to enhance the machining accuracy, the X-axial table 7 is designed and fabricated so as to exhibit a table pitching of at most 1 [μm]/100 [mm] and a table yawing of at most 1 [μm]/100 [mm].

As seen from FIG. 7, the coolant supply mechanism includes the nozzle 12 for injecting the coolant in the tangential direction of the grindstone 1, a pressure pump (not shown) for pressurizing the coolant so that the speed of the injected coolant may exceed the peripheral speed of the grindstone 1, and filter means (not shown) for purifying the recycled coolant. The pressure pump has a discharge rate of 20 [liters/min] and a discharge pressure of 20–80 [kg/cm$^2$]. Besides, in order to efficiently remove chippings contained in the recycled coolant, the filter means is configured of a filter of 1.0 [μm] and a filter of 0.5 [μm] which are disposed in sequence. By the way, the chippings which are greater than 0.5 [μm] amount to, is beyond 99 [%] of the whole quantity of the chippings in this embodiment.

The autobalancer has the balancer tank 3 disposed at the distal end part of the spindle. The magnitude of unbalance is sensed beforehand, and a liquid of proper volume is put in the appropriate place of the balancer tank 3. Thus, the autobalancer holds the dynamic balance of the rotating elements.

Next, the operation of the grinding machine will be described.

With this grinding machine, when the workpieces are ground by rotating the grindstone 1 (110 [mm] in diameter) so as to establish a peripheral speed of 4835 [m/min], the grinding resistance can be rendered about 40 [%] smaller than in the prior art, and hence, the grinding efficiency as well as the machining accuracy can be enhanced. Also, the lifetime of the grindstone 1 can be lengthened, and the power consumption can be curtailed.

The enhancement of the machining accuracy is based on, not only the decrease of the grinding resistance, but also the heightened rigidity of the spindle and the adoption of the autobalancer etc. Specific examples of the machining accuracy are a pitch accuracy enhanced 3 times and a groove width accuracy enhanced 2 times as indicated in FIG. 9. Besides, the lifetime of the grindstone is lengthened more than 6 times. Herein, the lifetime of the grindstone was measured in terms of the length [m] of a groove of predetermined accuracies which could be ground.

Regarding the workpiece feed speed and the depth of cut, it has been revealed that basically, as they have larger values, the volume of grinding per unit power consumption can be increased more. Therefore, the grinding efficiency can be heightened more with a smaller quantity of power consumption by carrying out the grinding under the conditions of, for example, a workpiece feed speed of 1000 [mm/min] and a depth of cut of 4 [mm] (an aspect ratio of 6.7).

It is common practice that the coolant is supplied to the part to-be-ground at a speed being considerably lower than the peripheral speed of the grindstone 1. With this expedient, however, air currents of high speeds are formed around the rotating grindstone 1, so that the coolant cannot be efficiently supplied to the part to-be-ground. In this embodiment, therefore, the coolant is supplied at the speed being not lower than the peripheral speed of the grindstone 1. Consequently, the coolant is efficiently supplied to the part to-be-ground, so that the cooling efficiency and the grinding efficiency of the machining can be raised.

According to one aspect of performance of the present invention, the grinding resistance can be decreased, so that the grinding efficiency and the grinding accuracy can be enhanced, and the power consumption can be curtailed.

Besides, according to another aspect of performance of the present invention, workpieces can be prevented from cracking, so that the grinding efficiency can be enhanced from the viewpoint of the overall productivity.

What is claimed is:

1. A grinding method wherein a workpiece made of a ceramic is ground by rotating a disk-shaped diamond grindstone having a plurality of diamond particles on a periphery of said grindstone; comprising the steps of:

preliminarily measuring a grinding resistance of said workpiece dependent upon a peripheral speed V of the diamond grindstone for each of different sorts of a plurality of diamond grindstones which have diamond particles of different average size therearound respectively, determining a minimum peripheral speed of the respective diamond grindstones at which said grinding resistance of said workpiece comes to hardly change any more, determining, based upon a relationship between said average size of diamond particles and said minimum peripheral speed of each of said diamond grindstone, a constance $k_1$ and a constant $\alpha$ in a first formula:

$$V \geqq k_1\phi+\beta$$

wherein $\phi$ represents an average size of the diamond particles, and V represents a peripheral speed of a diamond grindstone, to thereby complete said first formula;

measuring a limitation ratio between a peripheral speed of said diamond grindstones at which said workpiece does not crack and a feed speed of said workpiece, for said each diamond grindstone, and determine, based upon a relationship between said average size of diamond particles and said limitation ratio of each of said diamond grindstone, constants $k_2$ and $\beta$ in a second formula:

$$V/f \geqq k_2 + \beta$$

wherein f represents a feed speed of a workpiece and V/f represent a ratio between a peripheral speed of a diamond grindstone and a feed speed of a workpiece, to thereby complete said second formula;

calculating said peripheral speed of said each diamond grindstone and said feed speed of said workpiece on the basis of the completed formulae by substituting an average size of diamond grindstones to be used in grinding; and grinding said workpiece under conditions of said peripheral speed v and said feed speed of said workpiece f.

2. A grinding method wherein a workpiece made of Aluminum nitride ceramic is ground by rotation of a disk-shaped diamond grindstone having a plurality of diamond particles on a periphery of said grindstone; comprising the steps of:

setting a peripheral speed V (m/min) of said diamond grindstone at:

$$V \geqq 35\phi + 2000$$

wherein $\phi$ ($\mu$m) denotes the average particle size of said diamond grindstone; and rotating said grindstone at the so set revolution speed.

3. A grinding method wherein a workpiece made of Aluminum nitride ceramic is ground by rotating a disk-shaped diamond grindstone having a plurality of diamond particles on a periphery of said grindstone; comprising the steps of:

setting a ratio V/f between a peripheral speed V(m/min) of said diamond grindstone and a feed speed of f (m/min) of said workpiece at:

$$V \geqq 70\phi + 800$$

where $\phi$ ($\mu$m) denotes the average particle size of said diamond grindstone; and rotating said grindstone to grind the workpiece.

4. A grinding method wherein a workpiece made of Aluminum nitride ceramic is ground by rotating a disk-shaped diamond grindstone having a plurality of diamond particles on a periphery of said grindstone; comprising the steps of:

setting a peripheral speed V (m/min) of said diamond grindstone and a ratio V/f between said peripheral speed V of said diamond grindstone and a feed speed f (m/min) of said workpiece at:

$$V \geqq 35\phi + 2000 \text{ and}$$

$$V/f \geqq 70\phi + 800$$

where $\phi$ ($\mu$m) denotes the average particle size of said diamond grindstone.

* * * * *